US009991615B1

(12) United States Patent
Herring et al.

(10) Patent No.: US 9,991,615 B1
(45) Date of Patent: Jun. 5, 2018

(54) DUAL CONNECTOR SYSTEM HAVING A SECURING ANCHOR

(71) Applicant: TE CONNECTIVITY CORPORATION, Berwyn, PA (US)

(72) Inventors: Michael David Herring, Apex, NC (US); Dean Marlin Harmon, III, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/693,591

(22) Filed: Sep. 1, 2017

(51) Int. Cl.

| | |
|---|---|
| ***H01R 13/625*** | (2006.01) |
| ***H01R 12/70*** | (2011.01) |
| ***H01R 12/71*** | (2011.01) |
| ***H01R 13/631*** | (2006.01) |

(52) U.S. Cl.
CPC ..... *H01R 12/7005* (2013.01); *H01R 12/7082* (2013.01); *H01R 12/716* (2013.01); *H01R 13/631* (2013.01)

(58) Field of Classification Search
CPC ..... H01R 12/82; H01R 13/193
USPC ..... 439/342, 376, 326
See application file for complete search history.

(56) References Cited

U.S. PATENT DOCUMENTS 4,678,252 A * 7/1987 Moore ..... H01R 12/83 439/326
7,470,136 B2 * 12/2008 Yahiro ..... H01R 13/6275 439/326
8,787,711 B2 7/2014 Zbinden et al.

* cited by examiner

*Primary Examiner* — Phuong Dinh

(57) ABSTRACT

A dual connector system includes a host circuit board and first and second electrical connectors mounted to the host circuit board. The first electrical connector has a housing having a card slot for a module circuit board and the second electrical connector has a housing having an upper mating surface for the module circuit board. The housing has a hold down ledge having a hold down surface located below the upper mating surface. A dual connector module is mated to the first and second electrical connectors. The dual connector module includes a securing anchor extending below a module circuit board that engages the hold down surface and being captured below the hold down ledge to secure the dual connector module to the second electrical connector.

20 Claims, 6 Drawing Sheets

DUAL CONNECTOR SYSTEM HAVING A SECURING ANCHOR

BACKGROUND OF THE INVENTION

The subject matter herein relates generally to a dual connector system.

Dual connector systems include first and second electrical connectors mounted to a host circuit board that are electrically connected to a dual connector module. The dual connector module includes a module circuit board having connector interfaces for interfacing with the first and second electrical connectors. Typically communication components are mounted to the module circuit board. For example, electrical and/or optical components may be mounted to the module circuit board. In various applications an on-board optics module may be mounted to the module circuit board. Heat dissipation of the communication components may be provided, such as in the form of a heat sink thermally coupled to the communication components and supported by the module circuit board.

Mating of the dual connector module to the first and second electrical connectors typically involves loading the dual connector module into a first position in a vertical direction and then sliding the dual connector module to a second position in a horizontal direction to mate with the first and second electrical connectors. However, proper mating of the module circuit board to both electrical connectors simultaneously may be difficult. Additionally, securing the dual connector module to the first and second electrical connectors may be problematic. For example, holding the rear end of the dual connector module downward on the second electrical connector to ensure adequate electrical connection between the dual connector module and the second electrical connector may be problematic. Conventional dual connector systems utilize J-shaped hooks associated with second electrical connector to hold the module circuit board downward against the contacts of the second electrical connector. Notches are formed in the module circuit board to receive the J-shaped hooks. However, such notches take away potential component area of the module circuit board and narrow the paths for routing electrical traces through the module circuit board.

A need remains for a dual connector system that secures the dual connector module with the first and second electrical connectors on the host circuit board for proper mating.

BRIEF DESCRIPTION OF THE INVENTION

In one embodiment, a dual connector system is provided including a host circuit board having a front mounting area with a first electrical connector at the front mounting area having a housing having a card slot holding first contacts at the card slot being terminated to the host circuit board and a rear mounting area with a second electrical connector at the rear mounting area having a housing having an upper mating surface, a first side and an opposite second side and holding second contacts at the upper mating surface between the first and second sides. The housing has a hold down ledge having a hold down surface located below the upper mating surface. The dual connector system includes a dual connector module mated to the first and second electrical connectors having a module circuit board including an upper surface and a lower surface facing the host circuit board having at least one communication component on the upper surface and front contact pads proximate to the front edge for electrically connecting to the first electrical connector and rear contact pads remote from the front edge for electrically connecting to the second electrical connector. The dual connector module includes a securing anchor extending below the lower surface engaging the hold down surface and being captured below the hold down ledge to secure the dual connector module to the second electrical connector.

In another embodiment, a dual connector system is provided including a host circuit board having a front mounting area with a first electrical connector at the front mounting area having a housing having a card slot holding first contacts at the card slot being terminated to the host circuit board and a rear mounting area with a second electrical connector at the rear mounting area having a housing having an upper mating surface, a first side and an opposite second side and holding second contacts at the upper mating surface between the first and second sides. The housing has a hold down ledge having a hold down surface located below the upper mating surface. The dual connector system includes a dual connector module mated to the first and second electrical connectors having a module circuit board including an upper surface and a lower surface facing the host circuit board having at least one communication component on the upper surface and front contact pads proximate to the front edge for electrically connecting to the first electrical connector and rear contact pads remote from the front edge for electrically connecting to the second electrical connector. The dual connector module includes a securing anchor extending below the lower surface. The securing anchor has an anchor surface engaging the hold down surface and being captured below the hold down ledge to secure the dual connector module to the second electrical connector. At least one of the anchor surface and the hold down surface are angled to drive the module circuit board downward toward the upper mating surface as the securing anchor is mated with the hold down ledge.

In a further embodiment, a dual connector system is provided including a host circuit board having a front mounting area with a first electrical connector at the front mounting area having a housing having a card slot holding first contacts at the card slot being terminated to the host circuit board and a rear mounting area with a second electrical connector at the rear mounting area having a housing having an upper mating surface, a first side and an opposite second side and holding second contacts at the upper mating surface between the first and second sides. The housing has a hold down ledge having a hold down surface located below the upper mating surface. The dual connector system includes a dual connector module mated to the first and second electrical connectors having a module circuit board including an upper surface and a lower surface facing the host circuit board having at least one communication component on the upper surface and front contact pads proximate to the front edge for electrically connecting to the first electrical connector and rear contact pads remote from the front edge for electrically connecting to the second electrical connector. The dual connector module includes a securing anchor extending below the lower surface. The dual connector module is coupled to the host circuit board by lowering the dual connector module in a loading direction generally perpendicular to the host circuit board to a pre-staged position where the first connector interface is adjacent to the first electrical connector and the second connector interface is adjacent to the second electrical connector. The securing anchor is aligned rearward of and not engaged with the hold down ledge in the pre-staged position. The dual connector module is slid forward from the pre-staged position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads. The securing anchor is slid forward with the dual connector module to the mated position such that an anchor surface of the securing anchor engages the hold down surface and such that the securing anchor is captured below the hold down ledge in the mated position to prevent lift off of the dual connector module from the second electrical connector in the mated position.

DETAILED DESCRIPTION OF THE INVENTION

Figure 1:
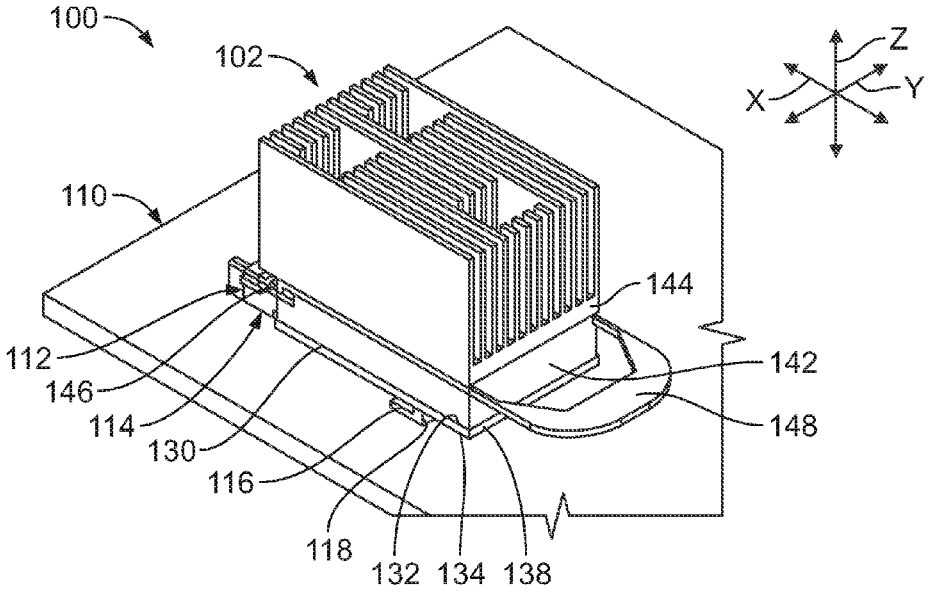
FIG. 1 is a perspective view of a dual connector system formed in accordance with an exemplary embodiment showing a dual connector module mounted to a host circuit board.
Figure 2:
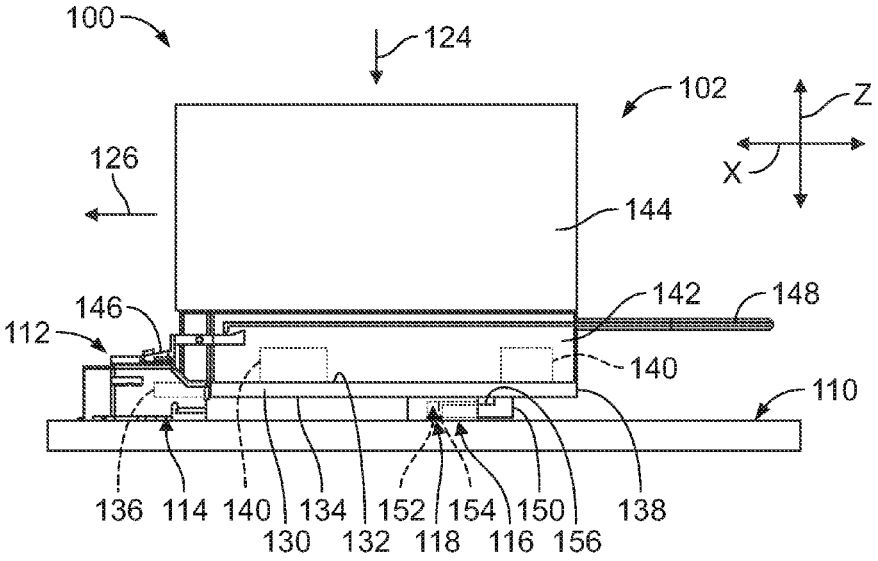
FIG. 2 is a side view of the dual connector system showing the dual connector module mounted to the host circuit board.

FIG. 1 is a perspective view of a dual connector system 100 formed in accordance with an exemplary embodiment showing a dual connector module 102 mounted to a host circuit board 110. FIG. 2 is a side view of the dual connector system 100 showing the dual connector module 102 mounted to the host circuit board 110. The host circuit board 110 has a first electrical connector 112 at a front mounting area 114 of the host circuit board 110 and a second electrical connector 116 at a rear mounting area 118 of the host circuit board 110.

When the dual connector module 102 is mounted to the host circuit board 110, the dual connector module interfaces with both electrical connectors 112, 116. Optionally, the dual connector module 102 may be simultaneously mated with the first and second electrical connectors 112, 116 during a mating process. In an exemplary embodiment, the first electrical connector 112 is a different type of electrical connector than the second electrical connector 116. For example, the first electrical connector 112 may be a front loaded electrical connector, such as a card edge connector. The second electrical connector 116 may be a top loaded electrical connector, such as a Z-axis or mezzanine connector. The electrical connectors 112, 116 may be used for different types of signaling. For example, the first electrical connector 112 may be used for high-speed signaling while the second electrical connector 116 may be used for low speed signaling, powering, or for another type of connection.

In an exemplary embodiment, mating of the dual connector module 102 to the host circuit board 110 occurs by loading the dual connector module 102 in a loading direction 124 (for example, Z-axis or downward) to a pre-staged position and then mating the dual connector module 102 in a mating direction 126 (for example, X-axis or forward) to a mated position. The loading direction 124 may be perpendicular to the host circuit board 110, such as in a vertical direction, and the mating direction 126 may be parallel to the host circuit board 110, such as in a horizontal direction.

The dual connector module 102 includes a module circuit board 130 having an upper surface 132 and a lower surface 134. The module circuit board 130 extends between a front edge 136 (shown in phantom) and a rear edge 138. The lower surface 134 faces the host circuit board 110 and may be parallel to and spaced apart from the host circuit board 110 when mated to the electrical connectors 112, 116.

In an exemplary embodiment, the dual connector module 102 includes one or more communication components 140 on the upper surface 132 and/or the lower surface 134. The communication components 140 may be electrical components, optical components, or other types of components. In an exemplary embodiment, one or more of the communication components 140 may be on-board optical modules. The communication components 140 may include optical/digital converters for converting between optical and electrical signals. Other types of communication components 140 may be provided on the module circuit board 130, such as processors, memory modules, antennas, or other types of components.

In an exemplary embodiment, the dual connector module 102 includes a housing or shell 142 on the upper surface 132. The shell 142 encloses the communication components 140 and may enclose portions of the module circuit board 130. In an exemplary embodiment, the shell 142 extends generally around the perimeter of the module circuit board 130; however, portions of the module circuit board 130 may be exposed exterior of the shell 142. In an exemplary embodiment, the dual connector module 102 includes a heat sink 144 thermally coupled to one or more of the communication components 140. The heat sink 144 dissipates heat from the communication components 140. The heat sink 144 may be mounted to the shell 142 and/or the module circuit board 130. In an exemplary embodiment, the heat sink 144 extends substantially the entire length of the dual connector module 102. The heat sink 144 may have a plurality of fins having a large surface area for dissipating heat.

In an exemplary embodiment, the dual connector module 102 includes a latch 146 at a front end of the dual connector module 102 for latchably securing the dual connector module 102 to the first electrical connector 112. A tether 148 is coupled to the latch 146 and extends to the rear end of the dual connector module 102 for releasing the latch 146.

In an exemplary embodiment, the dual connector module 102 includes one or more securing anchors 150 (FIG. 2) for securing the dual connector module 102 to the second electrical connector 116. The securing anchor 150 may be removably coupled to the second electrical connector 116 during the mating process, such as when the dual connector module 102 is moved in the mating direction 126 from the pre-staged position to the mated position. For example, in the pre-staged position the securing anchor 150 is not coupled to the second electrical connector 116; however, in the mated position, the securing anchor 150 is coupled to the second electrical connector 116.

In an exemplary embodiment, the second electrical connector 116 includes a hold down ledge 152 having a hold down surface 154. The securing anchor 150 has an anchor surface 156 configured to engage the hold down surface 154 to secure the dual connector module 102 to the second electrical connector 116. In the illustrated embodiment, the hold down ledge 152 is provided at the rear of the second electrical connector 116. The securing anchor 150 is coupled to the hold down ledge 152 from behind the second electrical connector 116. The securing anchor 150 extends below the lower surface 134 of the module circuit board 130 to engage the second electrical connector 116. The securing anchor 150 is located between the module circuit board 130 and the host circuit board 110. The second electrical connector 116 does not include any J-hooks or other upwardly protruding towers or posts used by conventional electrical connectors for securing the module circuit board 130. As such, the module circuit board 130 does not need to include notches or other cutouts in the side edges to accommodate such J-hooks typical of conventional electrical connectors. As such, the module circuit board 130 has more surface area for mounting components and routing traces as compared to conventional module circuit boards.

As the securing anchor 150 is coupled to the hold down ledge 152 (for example, as the dual connector module 102 is slid forward toward the mated position), the hold down ledge 152 may pull downward on the securing anchor 150 to force the dual connector module 102 into electrical connection with the second electrical connector 116. The hold down ledge 152 prevents lift-off of the dual connector module 102 from the second electrical connector 116. In an exemplary embodiment, the hold down ledge 152 is located below the top or mating surface of the second electrical connector 116. For example, the hold down ledge 152 is located below the module circuit board 130.

Figure 3:
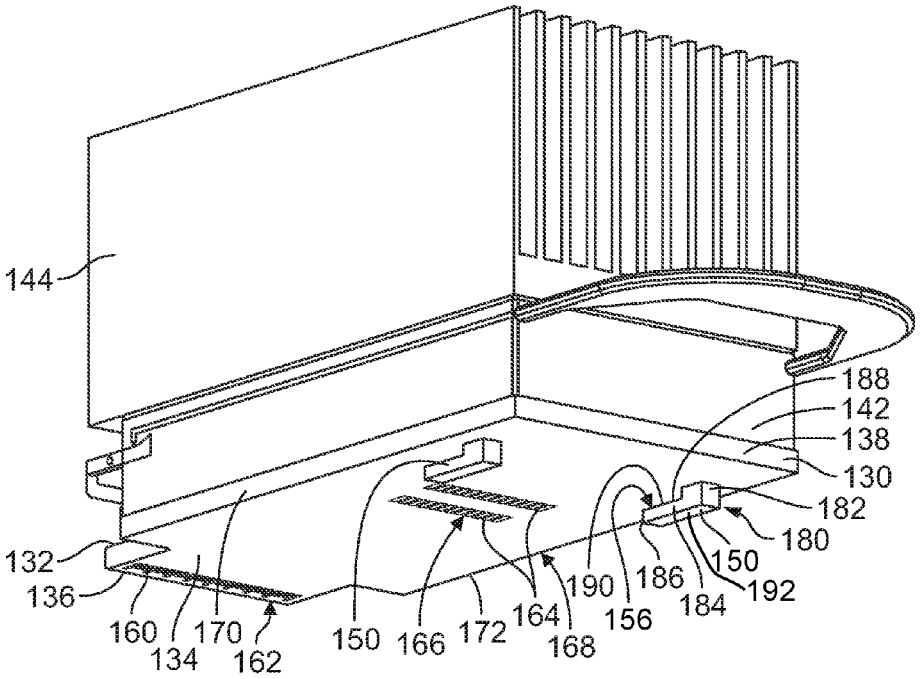
FIG. 3 is a bottom perspective view of the dual connector module in accordance with an exemplary embodiment.

FIG. 3 is a bottom perspective view of the dual connector module 102 and the securing anchors 150 in accordance with an exemplary embodiment. In an exemplary embodiment, the module circuit board 130 includes front contact pads 160 proximate to the front edge 136 along the lower surface 134 and/or the upper surface 132. The front contact pads 160 define a first connector interface 162 configured for electrically connecting to the first electrical connector 112 (shown in FIG. 2). For example, the first connector interface 162 may be a card edge interface at the front edge 136 configured to be plugged into a card slot of the first electrical connector 112. The front contact pads 160 are circuits of the module circuit board 130. The front contact pads 160 may be electrically connected to corresponding communication components 140 (shown in FIG. 2) via traces on various layers of the module circuit board 130. In an exemplary embodiment, the front contact pads 160 convey high speed data signals. Optionally, various front contact pads 160 may be arranged in pairs configured to carry differential signals.

The module circuit board 130 includes rear contact pads 164 on the lower surface 134 that define a second connector interface 166 configured for electrically connecting to the second electrical connector 116 (shown in FIG. 2). The rear contact pads 164 may be electrically connected to corresponding communication components 140 via traces on various layers of the module circuit board 130. Optionally, at least some of the rear contact pads 164 may be power pads configured to transmit power between the second electrical connector 116 and the module circuit board 130 for powering the communication components 140. Optionally, the rear contact pads 164 may be provided in multiple rows along the lower surface 134. The rear contact pads 164 are provided at an intermediate portion 168 of the module circuit board 130 remote from the front edge 136 and remote from the rear edge 138. Optionally, the rear contact pads 164 are positioned closer to the rear edge 138 than the front edge 136.

The securing anchors 150 are provided proximate to the rear end 138 of the module circuit board 130. Any number of securing anchors 150 may be provided, including a single securing anchor 150. In the illustrated embodiment, two securing anchors 150 are provided proximate to opposite side edges 170, 172 of the module circuit board 130; however, the securing anchors 150 may be provided at other locations in alternative embodiments. Optionally, the securing anchors 150 may be mounted to the module circuit board 130, such as to the lower surface 134; however, the securing anchors 150 may be mounted at other locations or to other structures, such as the shell 142 and/or the heat sink 144.

The securing anchor 150 may define a hook 180 configured to be received in the second electrical connector 116 under the hold down ledge 152. For example, the hook 180 may be forward facing to load into the second electrical connector 116 as the dual connector module 102 is slid forward to the mated position. The securing anchor 150 includes a base 182 extending from the module circuit board 130 and a beam 184 extending from the base 182 to a distal end 186. In the illustrated embodiment, the beam 184 extends forward from the base 182; however, the beam 184 may extend in other directions in alternative embodiments, such as inward toward a center of the dual connector module 102. The anchor surface 156 is defined at a top 188 of the beam 184. The anchor surface 156 may be a generally horizontal surface extending generally parallel to the module circuit board 130 in various embodiments; however, the anchor surface 156 may be ramped or angled in alternative embodiments. For example, in the illustrated embodiment, the anchor surface 156 includes a ramped surface 190 ramped upward between the distal end 186 and the base 182. Optionally, the ramped surface 190 may be angular. Alternatively, the ramped surface 190 may be curved. The ramped surface 190 may be positioned rearward of a flat surface (such as at the distal end 186) and/or forward of a flat surface (such as at the base 182). Having the anchor surface 156 ramped drives the securing anchor 150, and thus the dual connector module 102, downward as the securing anchor 150 is slide forward into the second electrical connector 116 to the mated position. Optionally, a bottom 192 of the beam 184 may be configured to rest on the host circuit board 110 to support the dual connector module 102 as the dual connector module 102 is slid forward to the mated position.

When assembled, the securing anchor 150 secures the dual connector module 102 to the second electrical connector 116. Optionally, the securing anchor 150 may be coupled to the second electrical connector 116 such that the securing anchor 150 induces a downward biasing force on the dual connector module 102 when the anchor surfaces 156 are driven along the hold down ledges 152 to force the rear contact pads 164 downward on corresponding contacts of the second electrical connector 116.

Figure 4:
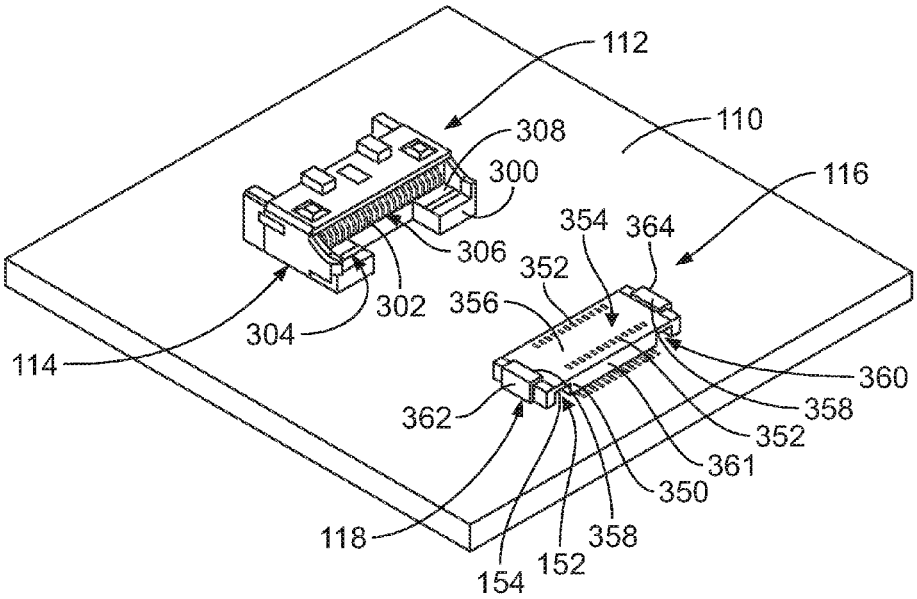
FIG. 4 is a top perspective view of the host circuit board in accordance with an exemplary embodiment.

FIG. 4 is a top perspective view of the host circuit board 110 in accordance with an exemplary embodiment. The host circuit board 110 includes mounting areas for mounting the dual connector module 102 (shown in FIG. 3) to the host circuit board 110. The mounting area is subdivided into the front mounting area 114 receiving the first electrical connector 112 and the rear mounting area 118 receiving the second electrical connector 116.

With additional reference to FIG. 4 for reference to components of the dual pluggable module 102, the first electrical connector 112 includes a housing 300 mounted to the host circuit board 110. The housing 300 holds a plurality of first contacts 302 configured to be terminated to the host circuit board 110. The housing 300 has a mating end 304 configured to be mated with the first connector interface 162 (FIG. 3) of the dual connector module 102. In an exemplary embodiment, the first electrical connector 112 includes a card slot 306 at the mating end 304. The first contacts 302 are arranged in the card slot 306 for mating with the first connector interface 162. For example, the first contacts 302 may be arranged in an upper row and a lower row for interfacing with the front contact pads 160 (FIG. 3) on the upper surface 132 and the lower surface 134 at the front edge 136 of the module circuit board 130.

The housing 300 includes locating surfaces 308 at the mating end 304 for locating the module circuit board 130 relative to the card slot 306 during mating. For example, the locating surfaces 308 may be upward facing surfaces configured to support the front edge 136 of the module circuit board 130 in the pre-staged position. The module circuit board 130 may slide along the locating surfaces 308 during mating as the front edge 136 of the module circuit board 130 is loaded into the card slot 306. The locating surfaces 308 may support the module circuit board 130 in the mated position to prevent damage to the first contacts 302 from the weight of the dual connector module 102.

Figure 5:
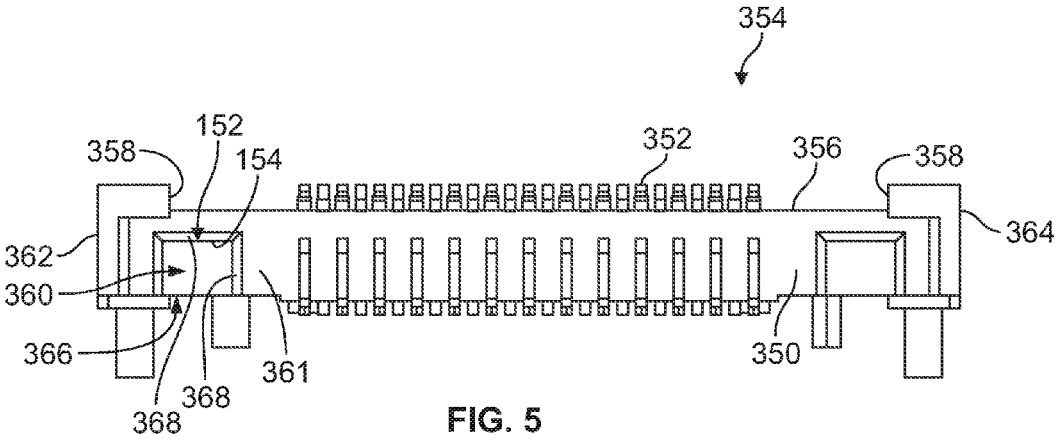
FIG. 5 is an end view of a second electrical connector of the host circuit board in accordance with an exemplary embodiment.

With reference to FIG. 5, which is an end view of the second electrical connector 116 in accordance with an exemplary embodiment, the second electrical connector 116 includes a housing 350 mounted to the host circuit board 110. The housing 350 holds a plurality of second contacts 352 configured to be terminated to the host circuit board 110. The housing 350 has a mating end 354 (for example, defining the top) configured to be mated with the second connector interface 166 (FIG. 3) of the dual connector module 102. In an exemplary embodiment, the second electrical connector 116 includes an upper mating surface 356 at the mating end 354. The second contacts 352 are arranged along the upper mating surface 356, such as in one or more rows, for mating with the second connector interface 166. The second contacts 352 may include deflectable spring beams configured to be resiliently biased against the second connector interface 166 when the dual connector module 102 is mated to the second electrical connector 116.

The housing 350 includes locating surfaces 358 at the mating end 354 for locating the module circuit board 130 during mating. For example, the locating surfaces 358 may be shoulders, flanges, tabs, and the like configured to locate the module circuit board 130 by restricting side-to-side movement of the module circuit board 130. The locating surfaces 358 may define a pocket that receives the module circuit board 130.

The housing 350 includes pockets 360 at a rear 361 of the housing 350. The pockets 360 receive the securing anchors 150. The pockets 360 are defined in part by the hold down ledges 152, which, in the illustrated embodiment, are at the tops of the pockets 360. The pockets 360 are located proximate to opposite sides 362, 364 of the housing 350 in complementary locations for receiving the securing anchors 150. Optionally, the pockets 360 may be open at a bottom 366 such that the host circuit board 110 is exposed at the bottom 366. In an exemplary embodiment, the pockets 360 have chamfered lead-in surfaces 368 to guide the securing anchors 150 into the pockets 360. For example, the lead-in surfaces 368 guide the securing anchors 150 to the hold down surfaces 154 at the tops of the pockets 360. In the illustrated embodiment, the housing 350 has discrete pockets 360 at the opposite sides 362, 364 that are separated by material of the housing 350. In alternative embodiments, the housing 350 may include a single pocket defined by a common hold down ledge 152 that receives multiple securing anchors 150.

The hold down surfaces 154 are generally downward facing to capture the securing anchors 150 under the hold down ledges 152. The hold down surfaces 154 may be generally horizontal surfaces extending generally parallel to the upper mounting surface 356 in various embodiments; however, the hold down surfaces 154 may be ramped or angled in alternative embodiments, such as to drive the securing anchor 150, and thus the dual connector module 102, downward as the securing anchor 150 is slide forward into the pocket 360 to the mated position. As such, the dual connector module 102 is forced downward into the upper mating surface 356 and the second contacts 352.

Figure 6:
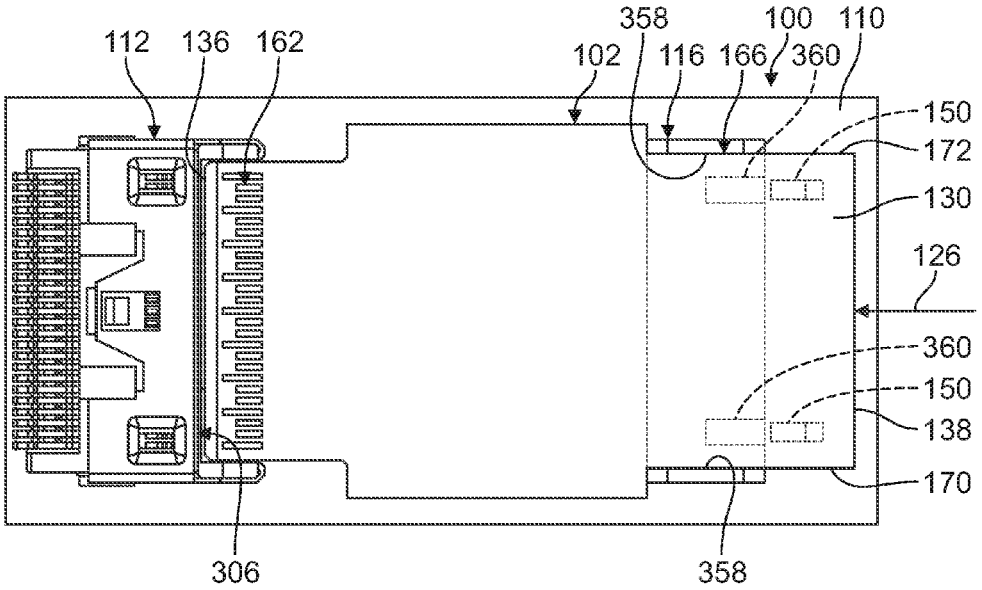
FIG. 6 is a top view of a portion of the dual connector system showing a module circuit board partially mated to the host circuit board.
Figure 7:
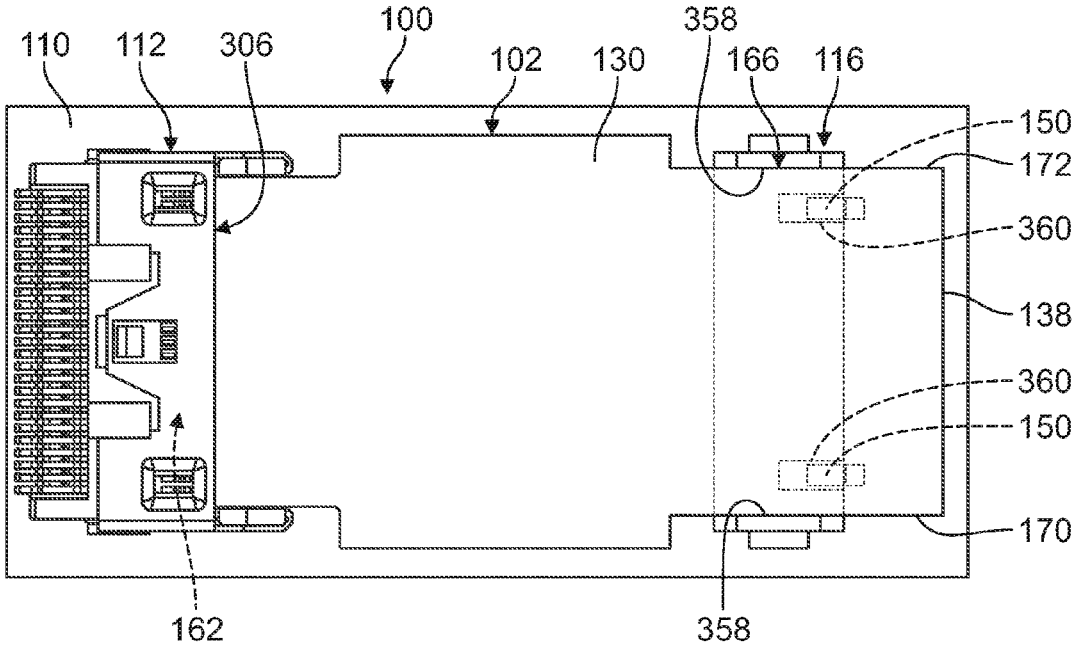
FIG. 7 is a top view of a portion of the dual connector system showing the module circuit board fully mated to the host circuit board.

FIG. 6 is a top view of a portion of the dual connector system 100 showing the module circuit board 130 partially mated to the host circuit board 110. FIG. 7 is a top view of a portion of the dual connector system 100 showing the module circuit board 130 fully mated to the host circuit board 110. The securing anchors 150 and the pockets 360 are shown in phantom in FIGS. 6 and 7.

In an exemplary embodiment, mating of the dual connector module 102 to the host circuit board 110 occurs by loading the dual connector module 102 in the loading direction 124 (shown in FIG. 2) to the pre-staged position (FIG. 6), such as by loading the dual connector module 102 downward onto the first and second electrical connectors 112, 116. Once positioned, the dual connector module 102 is mated to the first and second electrical connectors 112, 116 by moving the dual connector module 102 in the mating direction 126 to the mated position (FIG. 7).

During mating, the first connector interface 162 is generally aligned above the first electrical connector 112 and the second connector interface 166 is generally aligned above the second electrical connector 116 and the module circuit board 130 is lowered into position on the first and second electrical connectors 112, 116 to the pre-staged position. The front edge 136 of the module circuit board 130 rests on, and is supported by, the first electrical connector 112 in the pre-staged position (FIG. 6). The front edge 136 of the module circuit board 130 is aligned with the first electrical connector 112 such that the module circuit board 130 may be loaded straight into the first electrical connector 112. Optionally, the first and second side edges 170, 172 near the front edge 136 are stepped inward to allow the module circuit board 130 to plug in to the first electrical connector 112. Optionally, the first and second side edges 170, 172 near the rear edge 138 are stepped inward to fit within the locating surfaces 358 of the second electrical connector 116. However, the side edges 170, 172 do not include notches or other cutouts at the second electrical connector 116 as is typical of conventional module circuit boards that are connected using J-hooks. As such, the module circuit board 130 has more surface area for mounting components and routing traces as compared to conventional module circuit boards.

In the pre-staged position, the securing anchors 150 are located rearward of the second electrical connector 116 and aligned with the pockets 360. As the dual connector module 102 is lowered into the pre-staged position, the securing anchors 150 clear the second electrical connector 116 and are configured to be received in the pockets 360. For example, the securing anchors 150 are vertically aligned with the pockets 360 and horizontally aligned with the pockets 360 (for example, side-to-side).

To complete mating, the dual connector module 102 is moved from the pre-staged position (FIG. 6) to the mated position (FIG. 7) by sliding the module circuit board 130 forward. The front edge 136 is plugged into the card slot 306 to mate with the first electrical connector 112. In the mated position, the second connector interface 166 of the module circuit board 130 is aligned with the second electrical connector 116. During mating, the securing anchors 150 (shown in FIG. 1) are loaded into the pockets 360 and are captured below the hold down ledges 152. The interaction between the securing anchors 150 and the hold down ledge 152 (for example, interference fit and/or ramped surface(s)) cause the module circuit board 130 to press downward and seat against the second electrical connector 116.

Figure 8:
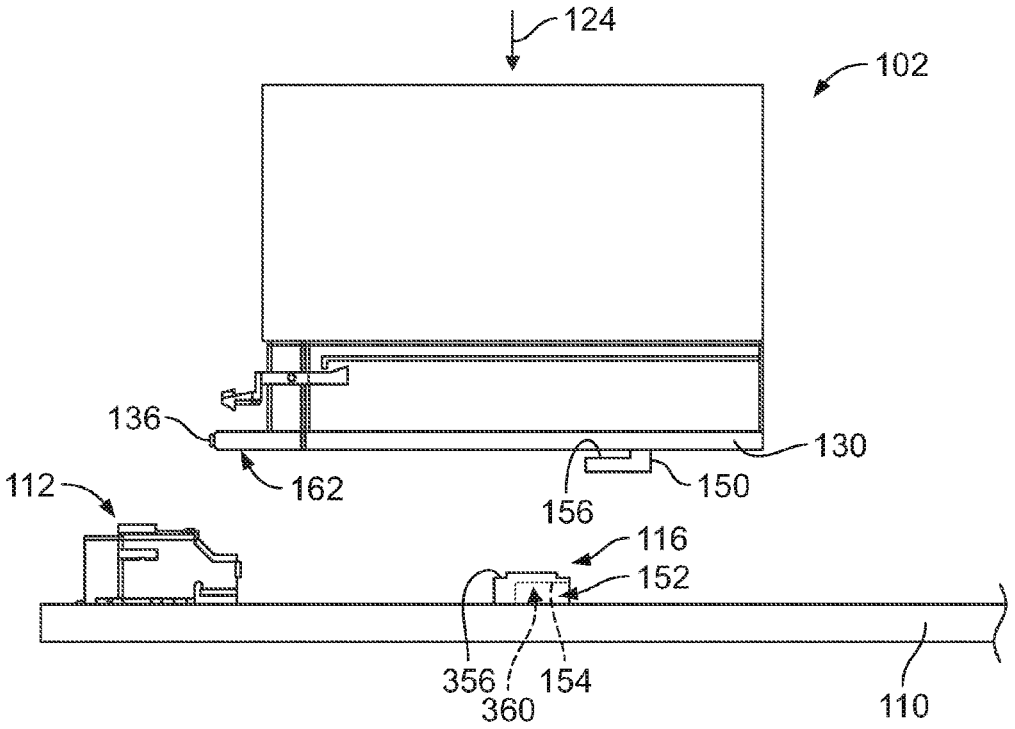
FIG. 8 shows the dual connector module poised for coupling to the host circuit board at an elevated positioned above the host circuit board.
Figure 9:
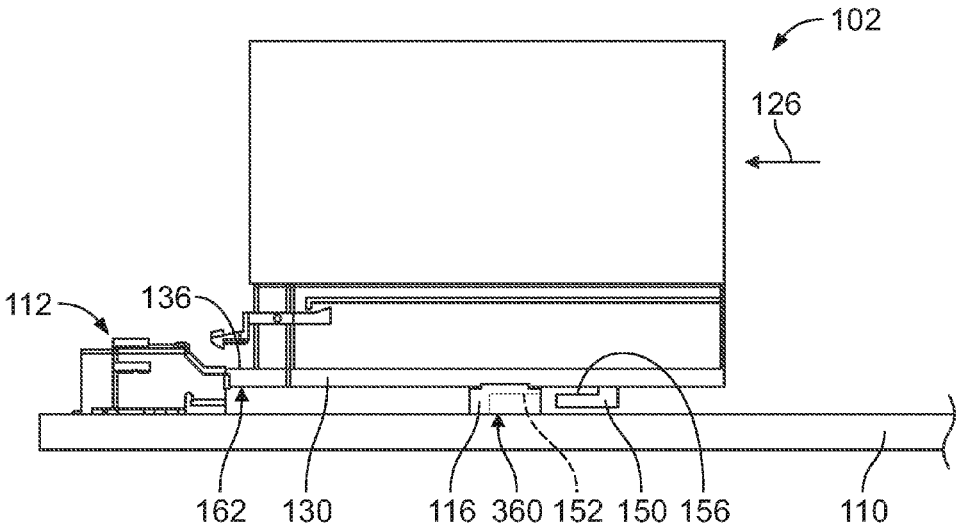
FIG. 9 shows the dual connector module in a pre-staged position on the host circuit board.
Figure 10:
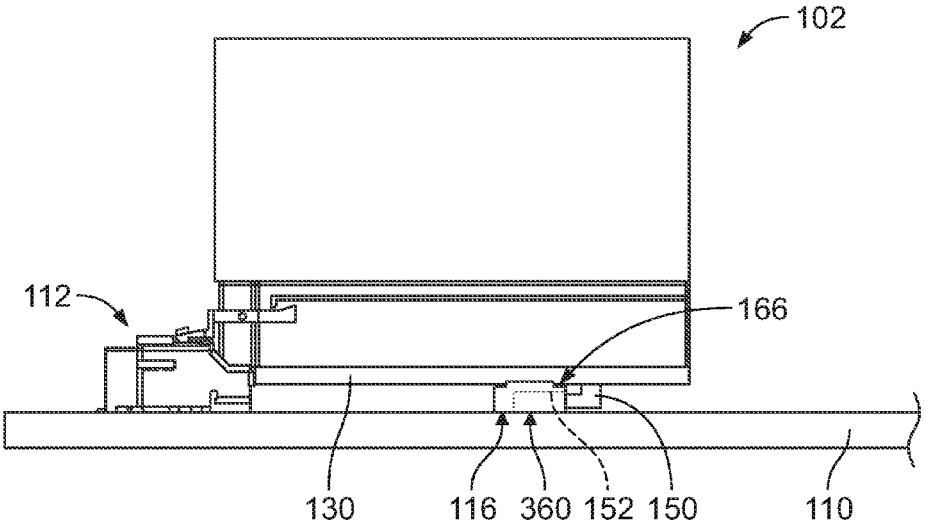
FIG. 10 shows the dual connector module in a mated position on the host circuit board.

FIGS. 8 through 10 show a mating sequence of the dual connector module 102 to the host circuit board 110. FIG. 8 shows the dual connector module 102 poised for coupling to the host circuit board 110 at an elevated positioned above the host circuit board 110. FIG. 9 shows the dual connector module 102 in a pre-staged position. FIG. 10 shows the dual connector module 102 in a mated position. The pockets 360 and the hold down ledge 152 are shown in phantom in FIGS. 8 through 10.

In an exemplary embodiment, mating of the dual connector module 102 to the host circuit board 110 occurs by loading the dual connector module 102 in the loading direction 124 to the pre-staged position (FIG. 9), such as by loading the dual connector module 102 downward onto the first and second electrical connectors 112, 116. Once positioned, the dual connector module 102 is mated to the first and second electrical connectors 112, 116 by moving the dual connector module 102 in the mating direction 126 to the mated position (FIG. 10).

During mating, the first connector interface 162 is generally aligned above the first electrical connector 112 and the second connector interface 166 is generally aligned above the second electrical connector 116 (FIG. 8) and the module circuit board 130 is lowered into position on the first and second electrical connectors 112, 116 to the pre-staged position (FIG. 9). The front edge 136 of the module circuit board 130 rests on, and is supported by, the first electrical connector 112 in the pre-staged position. In the pre-staged position (FIG. 9), the securing anchor 150 is located rearward of the second electrical connector 116 and aligned with the pockets 360.

As the dual connector module 102 is moved from the pre-staged position (FIG. 9) to the mated position (FIG. 10), the dual connector module 102 is moved forward to the mated position. The securing anchor 150 is received in the pocket 360 below the hold down ledge 152. The securing anchor 150 is coupled to the hold down ledge 152 to secure the rear end of the dual connector module 102 to the second electrical connector 116. The interference between the anchor surface 156 and the hold down surface 154 holds the dual connector module 102 downward on the second electrical connector 116 to prevent lift-off of the module circuit board 130 from the upper mating surface 356 of the second electrical connector 116.

Figure 11:
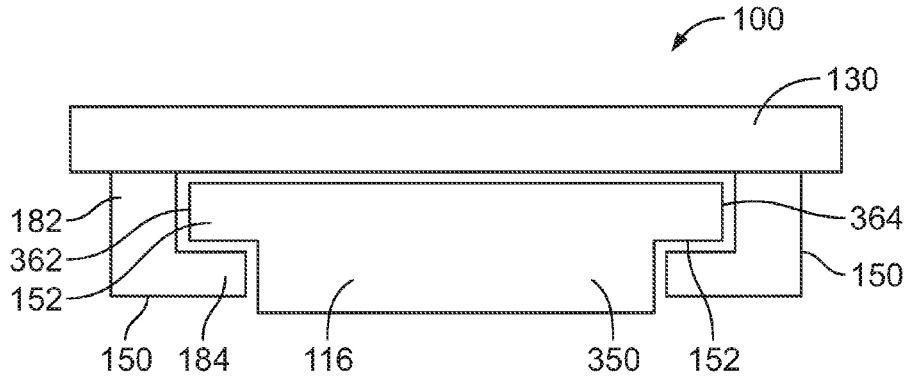
FIG. 11 is a rear view of a portion of the dual connector system in accordance with an exemplary embodiment.

FIG. 11 is a rear view of a portion of the dual connector system 100 showing the module circuit board 130 and corresponding securing anchors 150 in accordance with an exemplary embodiment coupled to the second electrical connector 116. In the illustrated embodiment, the securing anchors 150 face inward toward the center of the dual connector module 102 rather than forward as in the embodiment illustrated in FIG. 2. The beams 184 extend inward from the bases 182 rather than forward. The second electrical connector 116 includes the hold down ledges 152 at the first and second sides 362, 364. The bases 182 are positioned outside of the housing 350, such as outside of the sides 362, 364.

Figure 12:
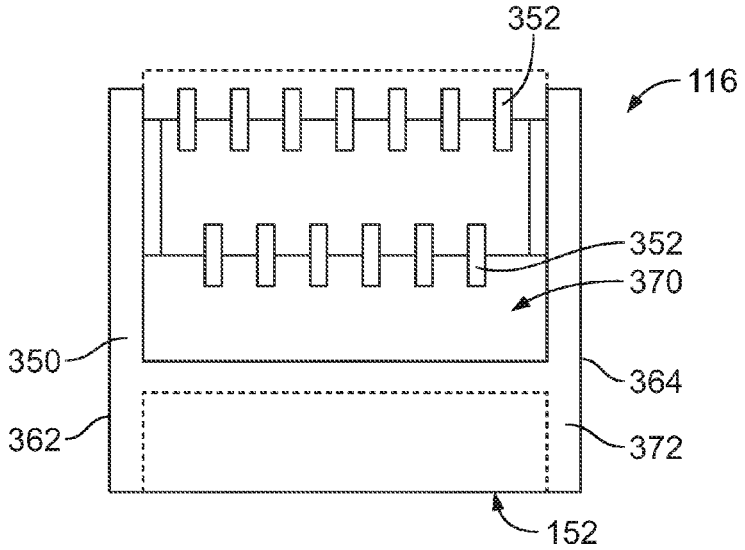
FIG. 12 is a top view of an electrical connector of the dual connector system in accordance with an exemplary embodiment.
Figure 13:
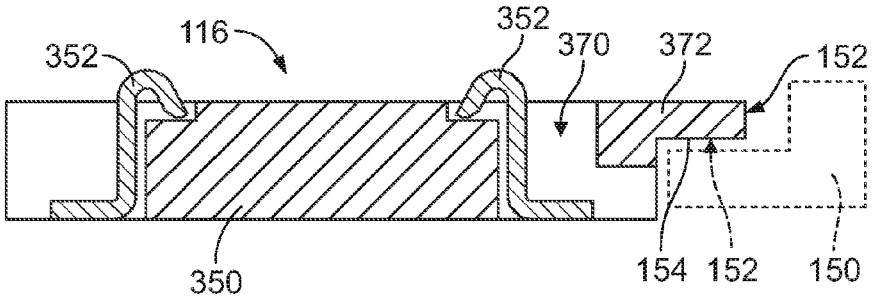
FIG. 13 is a side sectional view of an electrical connector of the dual connector system in accordance with an exemplary embodiment.

FIG. 12 is a top view of the second electrical connector 116 in accordance with an exemplary embodiment. FIG. 13 is a side sectional view of the second electrical connector 116 in accordance with an exemplary embodiment. The second electrical connector 116 includes a window 370 therethrough rearward of the second contacts 352. The window 370 provides access to the second contacts 352, such as for soldering the second contacts 352 to the host circuit board 110. The window 370 allows visual inspection of the second contacts 352 to verify the electrical connection with the host circuit board 110.

A rail 372 is located rearward of the window 370. The hold down ledge 152 is defined along the rail 372, such as along a bottom surface of the rail 372. In the illustrated embodiment, the hold down ledge 152 extends the width of the housing 350 between the sides 362, 364, rather than having separate pockets, such as the pockets 360 of the embodiment shown in FIG. 10. The hold down ledge 152 is configured to receive the securing anchor 150 (FIG. 13), which may extend the width of the dual connector module 102, such that the anchor surface 156 is captured below the hold down surface 154.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board;

a second electrical connector at the rear mounting area of the host circuit board, the second electrical connector having a housing having an upper mating surface, the housing having a first side and an opposite second side, the housing holding second contacts at the upper mating surface between the first and second sides, the second contacts being terminated to the host circuit board, the housing having a hold down ledge having a hold down surface located below the upper mating surface; and a dual connector module mated to the first and second electrical connectors, the dual connector module having a module circuit board including an upper surface and a lower surface facing the host circuit board, the module circuit board having at least one communication component on the upper surface, the module circuit board having front contact pads proximate to a front edge for electrically connecting to the first electrical connector, the module circuit board having rear contact pads remote from the front edge for electrically connecting to the second electrical connector, the dual connector module having a securing anchor extending below the lower surface, the securing anchor engaging the hold down surface and being captured below the hold down ledge to secure the dual connector module to the second electrical connector.

2. The dual connector system of claim 1, wherein the securing anchor holds the dual connector module downward on the upper mounting surface of the second electrical connector and prevents lift-off of the dual connector module from the upper mounting surface.

3. The dual connector system of claim 1, wherein the hold down ledge induces a downward mating force on the dual connector module when the securing anchor is coupled to the hold down ledge to force the rear contact pads downward on the second contacts of the second electrical connector.

4. The dual connector system of claim 1, wherein the securing anchor is positioned between the module circuit board and the host circuit board.

5. The dual connector system of claim 1, wherein the securing anchor includes an upward facing anchor surface positioned below and engaging the hold down surface.

6. The dual connector system of claim 1, wherein the $2^{nd}$ electrical connector defines a pocket between the hold down ledge and the host circuit board, the securing anchor being received in the pocket.

7. The dual connector system of claim 1, wherein the securing anchor includes a base extending downward from the module circuit board and a beam extending from the base, the beam including an anchor surface at a top of the beam engaging the hold down surface.

8. The dual connector system of claim 1, wherein the hold down ledge is defined at a rear of the housing of the $2^{nd}$ electrical connector.

9. The dual connector system of claim 1, wherein the hold down ledge is defined at the $1^{st}$ side of the housing of the $2^{nd}$ electrical connector.

10. The dual connector system of claim 1, wherein the hold down ledge is a $1^{st}$ hold down ledge and the securing anchor is a $1^{st}$ securing anchor, the $2^{nd}$ electrical connector comprising a $2^{nd}$ hold down ledge at the $2^{nd}$ side of the housing of the $2^{nd}$ electrical connector, the dual connector module including a $2^{nd}$ securing anchor extending below the lower surface, the $2^{nd}$ securing anchor engaging and being captured below the $2^{nd}$ hold down ledge to secure the dual connector module to the $2^{nd}$ electrical connector.

11. The dual connector system of claim 1, wherein at least one of the hold down ledge and the securing anchor include a chamfered lead-in.

12. The dual connector system of claim 1, wherein the hold down surface is angled nonparallel to the upper mounting surface to drive the securing anchor downward and force the rear contact pads downward toward the $2^{nd}$ contacts as the securing anchor is slid forward along the hold down surface to a mated position.

13. The dual connector system of claim 1, wherein the securing anchor includes an anchor surface at a top of the securing anchor, the anchor surface being angled nonparallel to the upper mounting surface to drive the securing anchor downward and force the rear contact pads downward toward the $2^{nd}$ contacts as the securing anchor is slid forward along the hold down surface to a mated position.

14. The dual connector system of claim 1, wherein the housing of the $2^{nd}$ electrical connector includes a window between the $2^{nd}$ contacts and the hold down ledge, the $2^{nd}$ contacts being visible through the window.

15. The dual connector system of claim 1, wherein the second electrical connector is configured to receive the module circuit board in a vertical loading direction from above the upper mating surface to a loaded position in which the securing anchor is aligned rearward of and not engaged with the hold down ledge, the second contacts being configured to mate with the module circuit board in a horizontal mating direction as the module circuit board is slid forward from the loaded position to a mated position, the securing anchor engaging the hold down ledge when the module circuit board is slid forward to the mated position.

16. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board;

a second electrical connector at the rear mounting area of the host circuit board, the second electrical connector having a housing having an upper mating surface, the housing having a first side and an opposite second side, the housing holding second contacts at the upper mating surface between the first and second sides, the second contacts being terminated to the host circuit board, the housing having a hold down ledge having a hold down surface located below the upper mating surface; and a dual connector module mated to the first and second electrical connectors, the dual connector module having a module circuit board including an upper surface and a lower surface facing the host circuit board, the module circuit board having at least one communication component on the upper surface, the module circuit board having front contact pads proximate to a front edge for electrically connecting to the first electrical connector, the module circuit board having rear contact pads remote from the front edge for electrically connecting to the second electrical connector, the dual connector module having a securing anchor extending below the lower surface, the securing anchor having an anchor surface engaging the hold down surface and being captured below the hold down ledge to secure the dual connector module to the second electrical connector;

wherein at least one of the anchor surface and the hold down surface are angled to drive the module circuit board downward toward the upper mating surface as the securing anchor is mated with the hold down ledge.

17. The dual connector system of claim 16, wherein the securing anchor holds the dual connector module downward on the upper mounting surface of the second electrical connector and prevents lift-off of the dual connector module from the upper mounting surface.

18. The dual connector system of claim 16, wherein the securing anchor is positioned between the module circuit board and the host circuit board.

19. The dual connector system of claim 16, wherein the $2^{nd}$ electrical connector defines a pocket between the hold down ledge and the host circuit board, the securing anchor being received in the pocket.

20. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board;

a second electrical connector at the rear mounting area of the host circuit board, the second electrical connector having a housing having an upper mating surface, the housing having a first side and an opposite second side, the housing holding second contacts at the upper mating surface between the first and second sides, the second contacts being terminated to the host circuit board, the housing having a first connector latching feature at the first side of the housing; and a dual connector module mated to the first and second electrical connectors, the dual connector module having a module circuit board including an upper surface and a lower surface facing the host circuit board, the module circuit board having at least one communication component on the upper surface, the module circuit board having front contact pads proximate to a front edge for electrically connecting to the first electrical connector, the module circuit board having rear contact pads remote from the front edge for electrically connecting to the second electrical connector, the dual connector module having a securing anchor extending below the lower surface; and wherein the dual connector module is coupled to the host circuit board by lowering the dual connector module in a loading direction generally perpendicular to the host circuit board to a pre-staged position where the first connector interface is adjacent to the first electrical connector and the second connector interface is adjacent to the second electrical connector, the securing anchor being aligned rearward of and not engaged with the hold down ledge in the pre-staged position;

wherein the dual connector module is slid forward from the pre-staged position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads; and wherein the securing anchor is slid forward with the dual connector module to the mated position such that an anchor surface of the securing anchor engages the hold down surface and such that the securing anchor is captured below the hold down ledge in the mated position to prevent lift off of the dual connector module from the second electrical connector in the mated position.

* * * * *